United States Patent [19]

Gysling et al.

[11] 4,042,392

[45] Aug. 16, 1977

[54] FORMAZAN IMAGES BY PHYSICAL DEVELOPMENT OF CATALYTIC METAL NUCLEI IMAGE

[75] Inventors: Henry James Gysling; Mark Lelental, both of Rochester, N.Y.

[73] Assignee: Eastman Kodak Company, Rochester, N.Y.

[21] Appl. No.: 567,667

[22] Filed: Apr. 14, 1975

[51] Int. Cl.[2] ..... G03C 5/24; G03C 1/40

[52] U.S. Cl. ..... 96/48 PD; 96/77; 96/75; 96/49; 96/88; 96/54; 96/60 R; 96/48 R; 96/48 HD; 427/33 T; 427/430 B; 106/1; 427/35

[58] Field of Search ..... 96/76 R, 77, 88, 54, 96/60 R, 48 PD, 48 R, 48 HD, 75, 49; 427/430 B, 337, 35, 27 E; 106/1

[56] References Cited

U.S. PATENT DOCUMENTS

| | | | |
|---|---|---|---|
| 3,152,903 | 10/1964 | Shepard et al. | 96/48 PD |
| 3,278,366 | 10/1966 | Schiele | 96/88 |
| 3,642,478 | 2/1972 | Brault et al. | 96/48 PD |
| 3,650,748 | 3/1972 | Yudelson | 96/48 PD |
| 3,663,225 | 5/1972 | McLeod | 96/48 PD |
| 3,700,448 | 10/1972 | Hillson et al. | 96/88 |
| 3,713,824 | 1/1973 | Manhardt | 96/48 PD |
| 3,719,490 | 3/1973 | Yudelson | 96/88 |
| 3,880,724 | 4/1975 | Gysling | 96/48 PD |

*Primary Examiner*—Won H. Louie, Jr.
*Attorney, Agent, or Firm*—Arthur H. Rosenstein

[57] ABSTRACT

A process for the formation of formazan dye images employing nuclei of metals from Groups VIIIB and/or IB of the periodic table to catalyze the reduction of tetrazolium salts to the corresponding formazan dye by a reducing agent.

17 Claims, No Drawings

FORMAZAN IMAGES BY PHYSICAL DEVELOPMENT OF CATALYTIC METAL NUCLEI IMAGE

BACKGROUND OF THE INVENTION

This invention relates to novel photographic processes, elements and physical developer solutions. In a particular aspect, it relates to the use of photosensitive compounds of metals from Groups VIIIB and/or IB of the periodic table in processes for the formation of formazan dye images.

A large number of photographic processes are known, ranging from conventional silver halide systems to various non-conventional processes such as diazo processes, photopolymerization and various direct printout or photochromic materials. An ideal photographic system requires only a small amount of exposure from the particular radiation source being used to record the desired information. Thus, high speed photographic systems are generally characterized by the incorporation of a catalytic amplification step. In conventional silver halide systems, this amplification step is the chemical reduction of silver halide catalyzed by the Ag(O) latent image.

It is known in the art to produce formazan dye images by the reduction of the corresponding tetrazolium salt. For example, U.S. Pat. No. 3,152,903 to Shepard describes a process wherein a light activated reducing agent (photoreductant) reduces a tetrazolium salt to a formazan dye. The two electron photoreductant system described in U.S. Pat. No. 3,152,903 requires that two photons of energy be absorbed by the light activatable reducing agent to form one molecule of formazan dye. The unit quantum type process described by Shepard is inherently slow requiring long exposure times.

The use of tetrazolium salts to replace silve metal in a fixing bath is described in U.S. Pat. Nos. 3,642,478; 3,655,382; and 3,671,244.

It is known that various compounds of metals from Group VIIIB and/or IB of the periodic table can be used to form latent image centers for the catalytic deposition of heavy metals from metal physical developer solutions. Processes of this type using palladium complexes are described in Yudelson and Gysling U.S. Pat. No. 3,719,490, Yudelson and Dernbach U.S. Pat. No. 3,598,587 and Yudelson and Dernbach U.S. Pat. No. 3,650,748. Processes of this type using copper complexes are described in copending applications Ser. No. 365,375 filed May 30, 1973, Ser. No. 365,374 filed May 30, 1973, and Ser. No. 409,828 filed Oct. 26, 1973.

The processes of preparing visible metal images from photogenerated metal nuclei described above have several disadvantages. These include (1) complex chemical formulations are required including such components as metal salt, reducing agent, complexing agent, pH buffers, stabilizers and brighteners; (2) such baths are often not stable for extended periods of time; (3) baths may require elevated temperatures to be useful; and (4) color images can not be obtained.

SUMMARY OF THE INVENTION

In accordance with the present invention, it has been found that nuclei of metals from Groups VIIIB and/or IB of the periodic table will catalyze the reduction of a tetrazolium salt to its formazan dye analog by a reducing agent that does not spontaneously reduce the tetrazolium salt in the absence of the nuclei. The reducing agents can be combined with the tetrazolium salt in a physical developer solution. However, elements comprising a photosensitive complex, the tetrazolium salt and the reducing agent are also useful in forming formazan dye images.

In a preferred embodiment of this invention a process for photographic reproduction of images is provided in which catalytic nuclei are formed by a process which includes the step of photographic exposure of light sensitive compounds of metals from Group VIIIB and/or IB of the periodic table and catalyzing the reduction of tetrazolium sal' by the step of developing the resulting latent image with a stable physical developer bath comprising a tetrazolium salt and a reducing agent.

In another embodiment, the tetrazolium salt and the reducing agent is combined with the light sensitive compound in the photosensitive composition. After imagewise exposure, development is then accomplished by contacting the exposed composition with a solvent or by heating.

In still other embodiments, the tetrazolium salt or the reducing agent can be combined with the light sensitive compound in the photosensitive composition. Development is then accomplished by contacting the exposed composition with a solvent containing the reactant, either tetrazolium salt or reducing agent, that was not incorporated in the composition.

When the tetrazolium salt and/or the reducing agent is incorporated in the photographic element, it is necessary that it be in reactive association with the photosensitive compound. By "reactive association" is meant the reactive components are in the same layer and/or in an adjacent layer and/or in a layer that is separated by a layer or layers that is permeable to the reactive components and byproducts.

PRACTICE OF THE INVENTION

Any method of producing nuclei of metals from Groups VIIIB and IB of the periodic table is useful in the practice of this invention. Vacuum deposited metal nuclei alone can serve as catalytic nuclei for the reduction of a tetrazolium salt to its formazan dye analog.

Numerous light sensitive compounds of metals from Groups VIIIB and IB of the periodic table can be used in the practice of this invention. Palladium complexes which are useful in forming the catalytic nuclei of this invention may be described by the general formula.

$$[Pd(A)_a(B)_b(C)_c(D)_d]_eG_g \qquad (I)$$

wherein

A, B, C, D are anionic or neutral ligands which can be the same or different and may be chosen from the group consisting of halide ligands such as bromine, chlorine, or iodine, a carboxylic acid ligand such as a malonate group, an oxalate group, etc., an aromatic ligand such as phenyl, styrene, naphthyl, etc., a nitrogen ligand such as ammonia, an amine such as methylamine, ethylamine, benzylamine, ethylenediamine, propanediamine, diethylenetriamine, tetraethylenepentamine, aminoethanol, methylaminoethanol, aminonaphthol, bipyridine, phenanthroline, ethylenediaminetetraacetic acid, etc.; a nitrile such as nitrilotriethanol, benzonitrile, etc., an imine such as iminodiethanol, an oxime such as salicylaldoxime or an azide such as benzhydrazide, a phosphorous ligand such as triarylphosphine, trialkylphosphine, trialkylphosphite, triarylphosphite etc., an arsenic ligand such as triarylarsine, trialkylarsine, etc., an antimony ligand such as triarylantimony, trialkylstibine, etc., thiocyanate, selenocyanate, tellurocyanate, nitrate, acetate and a sterically hindered polydentate ligand such as tetraethyldiethylenetriamine and the like, G is a counter cation or anion depending on the overall charge of [Pd(A)a(B)b(C)c(D)d] such as a hydrogen ion, an inorganic acid ion such as a chloride ion, a bromide ion, an iodide ion, a sulfate ion, a nitrate ion, a phosphate ion, etc., an organic acid ion such as an acetate ion, an acrylate ion, oxalate ion, a malonate ion, etc., a metal ion such as a sodium ion, a potassium ion, a calcium ion, a strontium ion, an aluminum ion, etc., an onium ion such as those containing nitrogen, phosphorus or sulfur like a quaternary ammonium ion, a quaternary phosphonium ion, a tertiary sulfonium ion, etc., and the like, G can also be tetraarylborate and,

*a, b, c* and *d* are integers from 0 through 4;

$a + b + c + d$ is an integer from 1 through 4;

*e* is 1 or 2; and

*g* is an integer from 0 through 8.

A useful class of palladium compounds is represented by the formula $$[PdLX]B(C_6H_5)_4$$

where L is the ligand N,N,N',N'-tetraethyldiethylenetriamine and X is halide such as Cl−, Br− or I−; SCN−, SeCN− or $BH_3CN$−. Typical palladium compounds described above are found in U.S. Pat. No. 3,719,490 to Yudelson and copending application Ser. No. 567,668, filed Apr. 14, 1975, by Gysling and Lelental entitled "Physical Development of Pd (II) Photosensitive Complexes" which are hereby incorporated by reference.

Copper (I) compounds useful according to the present invention are described in copending Ser. No. 365,375, filed May 30, 1973 entitled "Photosensitive Copper (I) Complexes" hereby incorporated by reference, and can be represented by the formula $$Cu[P(OR)_3]_nBN_3CN \quad \text{(II)}$$

wherein R is lower alkyl and *n* is an integer from 1 to 3.

Additional Copper I complexes useful in the present invention are described in U.S. Pat. No. 3,859,092 issued Jan. 7, 1975 hereby incorporated by reference and can be represented by the formulas $$[CuQ_{q1}V] \quad \text{or} \quad \text{(III)}$$

$$[CuQ_{q2}]V^1 \quad \text{(IV)}$$

In the first instance (formula III), the copper (I), the ligand and the anion are all coordinated so that the copper (I) ion has a coordination number of 2, 3, or 4.

Q is a monodentate or polydentate class *b* ligand which, when monodentate, has the formula WZ where W is a group V or group VI donor atom such as nitrogen, phosphorus, arsenic, antimony, bismuth, sulfur, selenium, and tellurium and Z represents the nonmetallic atoms needed to complete the ligand. When the ligand is bidentate, Q has the formula BWZ where B and W are donor atoms from group V or group VI and Z is as described above. Where the ligand is tridentate, Q has the formula BWYZ where Y is a donor atom and where the ligand is tetradentate, Q has the formula BWYY'Z where Y and Y' are non-coordinating anions.

The value of $q_1$ is an integer from 1 to 3 when Q is monodentate and 1 or 2 when Q is polydentate.

V is a monovalent coordinating anion. Examples of this art recognized class of materials are $BH_3CN$−, $N_3$−, $NO_3$−, halide ions such as Cl−, Br−, and I−, and boranes such as $BH_4$− and $B_9H_{13}$−. Monovalent coordinating anions useful herein are described in Cotton and Wilkinson, *Advanced Inorganic Chemistry,* 2nd ed., Chapter 26, N.Y. (1966).

In the complex $[CuQ_{q2}]V'$, (formula IV) the ligand is coordinated to the copper (I) but the anion is not. The coordination number of the Cu ion due to complexation by Q is 4.

The integer $q_2$ is either 2 or 4 and Q is as described above. When $q_2$ is 2, Q is a bidentate ligand such as 1,2-bis-(phenylseleno) ethane, 1,4-bis(ethyltelluro)butane, or the like and when $q_2$ is 4, Q is a monodentate ligand such as propyl sulfide, triphenylphosphine, triphenylstibene, tripropylarsine or the like.

V' is a non-coordinating monovalent anion. Examples of non-coordinating anions useful with the above Cu complexes are those having the formula $[BLMNR]^1$− wherein L, M, N and R are independently selected from the group consisting of aryl and alkyl such as tetraethylborate, tetraphenylborate and the like; perchlorate; nitrate; or tetrafluoroborate; and the like. Some non-coordinating anions can coordinate in certain cases depending on the nature of the ligands in the coordination sphere. Thus, nitrate is coordinated in $[Cu[P(C_6H_5)_3]_2NO_3]$, but non-coordinated in $Cu[NC(CH_2)_4CN]_2NO_3$. See M. J. Nolte G. Gafner, and L. M. Haines. *Chem. Commun.,* 1406 (1969), and W. A. Anderson et al, *Canadian Journal of Chemistry,* 49, 761 (1971).

Q may be a mixture of different ligands if desired.

Still other photosensitive compounds of metals from Groups VIIIB and IB of the periodic table are described in Canadian Pat. No. 899,141, Canadian Pat. No. 905,733 and in copending U.S. application Ser. No. 409,828, filed Oct. 26, 1973, the disclosures of which are hereby incorporated by reference.

Methods for the preparation, exposure and pretreatment of photographic elements containing the metal complexes described herein are given in detail in the respective above-noted references for the complexes.

The photosensitive complex may be either imbibed into a substrate or coated onto the substrate in a hydrophilic binder prior to imagewise exposure. Thus the substrate may be dipped in a bath of the complex and dried to render the element photosensitive. If desired, the complex may be added to a binder solution and coated onto the substrate by any means, such as dip coating, brushing, rolling, spraying hopper coating or the like.

The binder used as a vehicle for the photosensitive complex may be any of the hydrophilic binders used in photographic elements, including natural materials such as gelatin, albumin, agar-agar, gum arabic, alginic acid etc., and synthetic materials such as poly(vinyl alcohol), poly(vinyl pyrrolidone), cellulose esters, partially hydrolized cellulose acetate and the like. It is understood that although many binders may be used herein, the binder should not absorb appreciably in the region of sensitivity of the complex. The complex may be used with varying amounts of binder material. Preferably the complex to binder weight ratio is from about 3 : 1 to about 1 : 2.

The complex may be either imbibed into or coated onto any support typically used for photographic elements. Support materials used herein are subject to wide variation. Glass may be employed as may be metals such as aluminum, copper, zinc, and tin. Conventional film bases, such as cellulose acetate, cellulose nitrate, cellulose acetate butyrate, poly(ethylene terephthalate), polystyrene and paper including polyethylene coated paper and polypropylene coated paper are also used. If the complex is to be imbibed in the support, porous materials such as paper should be used.

The elements are typically exposed through a pattern of actinic radiation providing a latent image corresponding to the exposed or unexposed areas. The complexes are sensitive to actinic radiation such as ultraviolet rays generally in the wavelength range of 1800 to 4000 Angstroms. Some of the complexes are sensitive to visible radiation and some may be spectrally sensitized. Many sources of ultraviolet light may be used such as high vapor mercury lamps, carbon arc lamps, and the like. Some of the complexes as described herein are also sensitive to electron beam exposure as well as exposure to neutrons and $\alpha$-particles.

In some instances, the rate of development of the coated supports is considerably accelerated by heating the exposed elements prior to treatment with the developer. In this respect, a shorter exposure time to achieve a developable image may be used if the element is heated after exposure and prior to development. Generally, the element may be heated to about 100° C. to about 200° C. for about 1 to about 60 seconds to exhibit this effect.

In contrast to the coverages of light sensitive compound for use with metal physical development baths, the process of this invention allows a much lower coverage of the light sensitive compound. The coverage of the light sensitive complex in an element as described herein can be a factor of 10 less than for metal physical development systems. Coverages as low as 0.1 mg. per 0.093 $m^2$ of the compounds of metals from Groups VIIIB or IB of the periodic table are useful. The photographic speed and contrast will increase with increasing coverage of the light sensitive compound. The preferred coverage is in the range of about 1 mg./0.093 $m^2$ to about 100 mg./0.093 $m^2$.

Photographic elements containing the tetrazolium salts and/or reducing agent can be prepared by incorporating these components with the coating composition containing the photosensitive compound. Alternatively, the tetrazlium salt and/or the reducing agent may becoated in a separate layer or layers which are in reactive association using suitable coating compositions. When incorporated in the photographic element, the tetrazolium salt can be present in the amounts between about 1 mg./0.093$m^2$ and about 100 mg./0.093$m^2$ and the reducing agent can be present in amounts between about 1 mg./0.093$m^2$ and about 200 mg./0.093$m^2$.

An extremely wide variety of tetrazolium salts may be used in the practice of the present invention. It is understood that the term "tetrazolium salt" throughout the application includes tetrazolium salts, ditetrazolium salts and tetrazolium betaines, and other reducible dye precursors.

Useful tetrazolium salts are described in *The Chemistry of Formazans and Tetrazolium Salts,* A. W. Nineham, *Chem. Rev.,* 55, 355 (1955) hereby incorporated by reference. The synthesis of tetrazolium salts and the chelation of formazan dyes are also described in the above reference.

Tetrazolium salts useful in the present invention include compounds having the general formula:

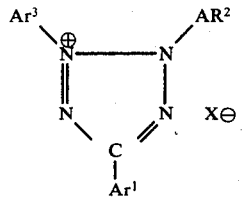

Wherein $Ar^1$, $Ar^2$ and $Ar^3$ may be the same or different and represent phenyl groups or phenyl groups substituted with electron withdrawing groups such as nitro, methoxy and the like or electron donating groups such as alkyl; and $Ar^3$ can also represent a 4,5-dialkyl-2-thiazolyl group containing 1 to 5 carbon atoms in the alkyl group or a 2-benzthiazolyl group; and $X^-$ is an anion such as a halide, acetate, tetrafluoroborate and the like.

Ditetrazolium salts useful in this invention include compounds of the formula:

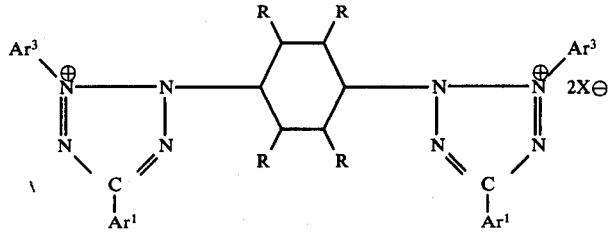

wherein $Ar^1$, $Ar^3$ and $X^-$ are as described above and R represents hydrogen or an electron withdrawing group such as methoxy, nitro, and the like.

Specific examples of tetrazolium salts and methods for their preparation, can be found in Canadian Pat. No. 860,873 which is hereby incorporated by reference.

Triazolium salts may also be employed as reducible dye precursors in the practice of this invention. These are colorless compounds that are reduced by the process of the invention to colored azo-amine dyes. Exemplary triazolium salts are disclosed in *Research Disclosure,* Item No. 12617, vol. 126, Oct. 1974 at Table IV.

Typical reducing agents useful in the practice of this invention are, polyhydroxy-substituted aryl compounds such as hydroquinones, catechols and pyrogallols; ascorbic acid derivatives; aminophenols; p-phenylenediamines and the like developing agents used in the photographic art. Other useful reducing agents are disclosed in Chapter 13 of Mees and James, "The Theory of the Photographic Process", third edition, New York, 1966. Particular examples of reducing agents for physical developer solutions are 2-methyl-3-chlorohydroquinone, bromohydroquinone, catechol, 5-phenyl-catechol, pyrogallol monomethyl ether (1-methoxy-2,3-dihydroxybenzene) and 5-methylpyrogallol monomethyl ether, isoascorbic acid, N-methyl-p-aminophenol, dimethyl-p-phenylenediamine, 4-amino-N,N-di(n-propyl)-aniline and 6-amino-1-ethyl-1,2,3,4-tetrahydroquinoline. Borane type reducing agents can be used to particular advantage with the sterically hindered complexes of formula (I). Borane reducing agents useful with these complexes are described in U.S. Pat. No. 3,650,748 to Yudelson et al. which is hereby incorporated by reference. These borane reducing agents include amine boranes, boronium salts, phosphine boranes, arsine boranes and stibine boranes. Another class of useful boron-containing reducing agents comprises cations of the general formula $[R_1R_2BH_2]^+$ as described in Miller and Rejschkewitsch, J. Am. Chem. Soc., 92, 1558 (1970). A comprehensive list of specific reducing agents is disclosed by Yudelson in col. 2 of U.S. Pat. No. 3,650,748. Common reducing agents such as sodium hypophosphites, hydrosulfites, borohydrides, hydrazines and the like can also be used.

The concentration of the reducing agent in the physical developer or element varies greatly with the characteristics of the other components in the developer or element. With evaporated palladium nuclei for example, the useful concentration range in a dye physical developer of mild reducing agents such as sodium hypophosphite can be between 1 and 100 grams per liter. In the preferred embodiment where borane type reducing agents are used with sterically hindered palladium complexes, the concentration range of the reducing agent can be between 0.1 and 50 grams per liter. The concentration and relative strength of the reducing agent is chosen so that the physical developer does not spontaneously reduce the unexposed metal complex or spontaneously reduce the tetrazolium salt. However, the concentration of the reducing agent should be sufficient to reduce the tetrazolium salt in the presence of nuclei of metals from groups VIIIB and IB of the periodic table.

Physical developer baths can be made from substantially equal volumes of a solution of a tetrazolium salt and a solution of a reducing agent. The resulting physical developer bath is considered useful if the tetrazolium salt is not spontaneously reduced to formazan dye but is reduced to formazan dye when palladium (0) or other catalyst is added to the bath. By spontaneously, it is meant that the formazan dye is formed essentially instantaneously without the metal nuclei. It should be understood that the physical developer is useful if it is stable for a time long enough to process the element. Typically, however, physical developer baths of this invention are stable for several days or longer.

The physical developers useful in the present invention can be simple solvent solutions of the tetrazolium salt and the reducing agent. The solvent is one in which the tetrazolium salt is soluble and the corresponding formazan dye as well as the photosensitive compound is insoluble. Mixtures of solvents may also be used to advantage. For example, the solubility of a tetrazolium salt in aqueous solution may be enhanced by the addition of methanol. Other useful solvents besides water include methyl alcohol, ethyl alcohol, acetonitrile and the like.

The solution can be saturated with the tetrazolium salt but is useful with as little as about 0.1% tetrazolium salt by weight of the solvent.

The incorporation of salts of common divalent metal ions such as copper (II), nickel (II), zinc (II), cobalt (II) and the like in these developer formulations produces an enhanced dye density as well as increased light stability of the dye deposit by producing a metal chelate dye image. Chelation of formazan dyes is discussed in A. W. Nineham, *Chem. Rev.*, 55 355 (1955). For use in the physical developers of this invention, the salts of divalent metals should be chosen so that the metals are not spontaneously reduced by the reducing agent in the physical developer.

For convenience, the temperature of the developer solution can be room temperature (about 20° C.) although higher and lower temperatures are useful. Solubility considerations for the tetrazolium salt generally determine the lower limit while the upper limit is generally determined by the thermal stability of the tetrazolium salt.

The rate of the development of the nuclei image can vary greatly depending on the choice of components. Typically the formazan dye is formed between 5 seconds and 5 minutes after the application of the reducing agent. The lower dye image formation times can be achieved at elevated temperatures (50° C.) using relatively strong reducing agents.

The photographic speed of the present process is partly a function of the pH of the dye physical developer, the speed increasing with increasing pH. This is shown for example in Examples 1 and 14. The useful pH range, depending on the reducing agent, is between about pH 4 and about pH 13. The preferred range is between pH 9 and pH 13. The developer solution can be brought within the desired pH range by the addition of appropriate amounts of suitable basic material such as ammonium hydroxide or sodium hydroxide. Other bases known to those skilled in the art can be substituted for these compounds. The solution can be maintained at the desired pH by incorporating in the solution a suitable buffering system such as a mixture of sodium carbonate and sodium bicarbonate. Other suitable buffering systems will be readily apparent to those skilled in the art.

The process of this invention can utilize either the solubility change or the color characteristics of the tetrazolium salt to formazan dye reduction reaction. In one preferred embodiment the essentially insoluble formazan dye is deposited imagewise in a photographic element from a tetrazolium salt-reducing agent developer by the metal catalyst formed by the imagewise exposure of a compound of a metal from group VIIIB or IB of the periodic table. In another embodiment, an essentially colorless tetrazolium salt can be incorporated in a photographic element in reactive association with the light sensitive metal compound. After exposure to form a metal latent image, a highly colored formazan dye image is formed when the element is processed in a developer solution containing a reducing agent.

In still another embodiment the essentially colorless tetrazolium salt and a reducing agent can be combined in reactive association with the photosensitive compound. After exposure to form a metal latent image a formazan dye image is formed by development of the element in a solvent solution. The solvent in this embodiment is chosen to allow diffusion of the tetrazolium salt and reducing agent to and away from the catalyst surface.

The above processes are negative working. That is formazan dye is formed in the exposed areas of the element. The process can, however, be employed in a positive working manner in which formazan dye is formed in the unexposed areas of an element. In such a process the photosensitive element is exposed in the usual manner and is then contacted with an element into which has been imbibed the tetrazolium salt-reducing agent physical developer. In the unexposed areas of the photosensitive element, metal compound diffuses to the receiver element where it is reduced and catalyzes the reduction of the tetrazolium salt to formazan dye. Heat may be applied to promote the diffusion of the unexposed metal compounds. Contact temperatures of from 45° C. to 100° C. are suitable. The image formed on the receiving element can be used as such or it can be intensified by immersing the receiver element in the dye physical developer bath. In this embodiment, a relatively stronger reducing agent is necessary than in embodiments where it is necessary that the reducing agent does not spontaneously reduce the metal compound. When used in a developer bath for a receiver element the reducing agent is chosen so that it is strong enough to reduce the metal compound but not strong enough to spontaneously reduce the tetrazolium salt in the absence of nuclei of metals from Group VIIIB or IB of the periodic table.

The following further illustrate the invention

Table I identifies the various tetrazolium salts disclosed in the examples.

Table I.

Tetrazolium Salt Formulas

A. 2,3,5-triaryl-2H-tetrazolium salts:

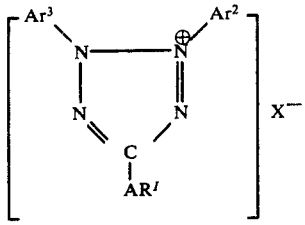

| No. | $Ar^1$ | $Ar^2$ | $Ar^3$ | $X^-$ |
|---|---|---|---|---|
| 1 | $C_6H_5$ | $C_6H_5$ | $C_6H_5$ | $Cl^-$ |
| 2 | $C_6H_5$ | $C_6H_5$ | $C_6H_5$ | $Br^-$ |
| 3 | $C_6H_5$ | p-I—$C_6H_4$ | p-$NO_2$—$C_6H_4$ | $Cl^-$ |
| 4 | $C_6H_5$ | 1-naphthyl | $C_6H_5$ | $Cl^-$ |
| 5 | $C_6H_5$ | p-$CH_3O$—$C_6H_4$ | $C_6H_5$ | $Br^-$ |
| 6 | $C_6H_5$ | m-Br—$C_6H_4$ | $C_6H_5$ | $Br^-$ |
| 7 | $C_6H_5$ | p-CN—$C_6H_4$ | $C_6H_5$ | $Br^-$ |
| 8 | p-$NO_2$—$C_6H_4$ | $C_6H_5$ | $C_6H_5$ | $Br^-$ |
| 9 | $(CH_3)$ | $C_6H_5$ | $C_6H_5$ | $Br^-$ |
| 10 | $C_6H_5$ | $C_6H_5$ | $C_6H_5$ | $BF_4$ |

B. 2,5-diaryl-3-thiazolyl-2H-tetrazolium salts 1) 2,5-diaryl-3-benzthiazolyl-2H-tetrazolium salts Table I.-continued

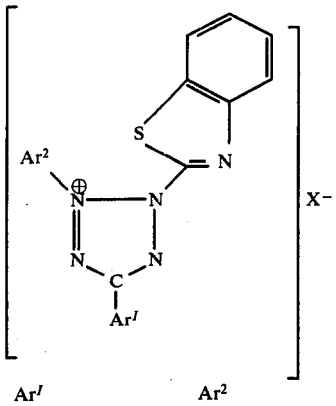

| No. | $Ar^1$ | $Ar^2$ | $X^-$ |
|---|---|---|---|
| 11 | $C_6H_5$ | $C_6H_5$ | $Br^-$ |
| 12 | p-$NO_2$—$C_6H_4$ | p-$NO_2$—$C_6H_4$ | $Br^-$ |
| 13 | p-$NO_2$—$C_6H_4$ | $C_6H_5$ | $Br^-$ |
| 14 | $C_6H_5$ | $C_6H_5$ | $Cl^-$ |

No.

2) 15 3-(4,5-dimethyl-2-thiazolyl)-2,5-diphenyl-2H-tetrazolium bromide (monothiazolyltetrazolium)

C. Ditetrazolium salts:

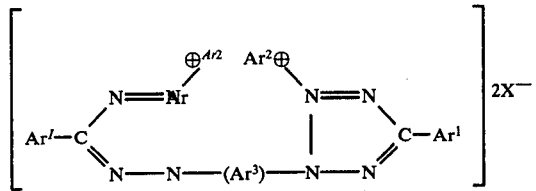

| No. | $Ar^1$ | $Ar^2$ | $Ar^3$ | $X^-$ |
|---|---|---|---|---|
| 16 | $C_6H_5$ | p-$NO_2$—$C_6H_4$ | 3,3'-dimethoxy-4,4'-biphenylene | $Cl^-$ |
| 17 | $C_6H_5$ | $C_6H_5$ | 3,3'-dimethoxy-4,4'-biphenylene | $Cl^-$ |
| 18 | $C_6H_5$ | $C_6H_5$ | 4,4'-biphenylene | $Cl^-$ |
| 19 | p-$NO_2$—$C_6H_4$ | p-$NO_2$—$C_6H_4$ | 3,3'-dimethoxy-4,4'-biphenylene | $Cl^-$ |

D. Tetrazolium Betaines 20 dehydrodithizone

EXAMPLES 1-42

Palladium nuclei were deposited on microscope slides by vacuum evaporation. Coverages of the palladium nuclei on the slides ranged from $8 \times 10^{-7}$ g/cm² to $1 \times 10^{-9}$ g/cm². Samples of the slides were immersed in a mixture of equal volumes of a tetrazolium salt solution and a reducing agent solution. The "critical developable coverage" is the minimum coverage of the palladium that is necessary for the formation of a dark colored formazan dye image in the developer solution shown. Formulas for the tetrazolium salt are given in Table 1. Experiments were carried out with the developer solutions at room temperature. The time of development varied from 2 to 5 minutes. Critical developable coverage for various reducing agents and tetrazolium salts and their concentrations and solvents are shown in Table 2.

Table II

| | Developer | Formulation | |
|---|---|---|---|
| Ex. | Tsalt/conc./solvent | Reducing Agent Solution | Critical Coverage $\times 10^9$ (g/cm²) |
| 1 | 1, 5%, $H_2O$(pH 8.8)[a] | 2% aqueous DMAB[b] | 50 |
| 2 | 1, 5%, $H_2O$ | 130g paraformaldehyde + 120gKOH/1 liter $H_2O$ | 50 |
| 3 | 1, 5%, $H_2O$ | 0.2M $NaH_2PO_2$ in $H_2O$ | 200 |

Table II-continued

| Ex. | Developer Tsalt/conc./solvent | Formulation Reducing Agent Solution | Critical Coverage $\times 10^9$ (g/cm$^2$) |
|---|---|---|---|
| 4 1, 5%, $H_2O$ | 4% p-$NH_2C_5H_4NBH_3$ | 9 in methanol | |
| 5 | 1, 5%, $H_2O$ | 200 mg methylhydrazine bisborane in 100 ml $H_2O$ | 3 |
| 6 | 1, 5%, $H_2O$ | 1% hydrazine in $H_2O$ | 50 |
| 7 | 1, 5%, $H_2O$ | 100 mg $NaBH_4$ in 100 ml $H_2O$ | 25 |
| 8 | 1, 5%, $H_2O$ | 2.4 g. $[(CH_3NH_2)_2BH_2]^{30}Cl-$ in 100 ml $H_2O$ | |
| 9 | 1, 5%, $H_2O$ | 2 g. $[(NH_3)_2BH_2]+Cl-$ in 100 ml $H_2O$ | 9 |
| 10 | 15, 1%, $H_2O$ | 1% aqueous DMAB | 3 |
| 11 | 15, 1%, $H_2O$ | 130 g. paraformaldehyde + 120 g. KOH/1 liter $H_2O$ | 10 |
| 12 | 15, 1%, $H_2O$ | 100 mg ammonia borane in 100 ml $H_2O$ | 2 |
| 13 | 3, .5%, $H_2O$ | 4% aqueous DMAB | 35 |
| 14 | 1, 5%, $H_2O$ (pH 13.0)[a] | 2% aqueous DMAB | 3.0 |
| 15 | 2, 1%, $H_2O$ | 2% aqueous DMAB | 4.0 |
| 16 | 3, 0.5%, $H_2O$ | 2% aqueous DMAB | 35.0 |
| 17 | 4, 1.0%, $H_2O$ | 2% aqueous DMAB | 9.0 |
| 18 | 5, 1.0%, 1:1 $H_2O$-EtOH | 2% aqueous DMAB | <9.0 |
| 19 | 6, 1.0%, 1:1 $H_2O$-EtOH | 2% aqueous DMAB | 12.0 |
| 20 | 6, 1.0%, 1:1 $H_2O$-EtOH | 1% aqueous hydrazine | <9.0 |
| 21 | 7, 1.0%, 1:1 $H_2O$-EtOH | 2% aqueous DMAB | <9.0 |
| 22 | 7, 1.0%, 1:1 $H_2O$-EtOH | 1% aqueous hydrazine | <9.0 |
| 23 | 8, 1.0%, 1:1 $H_2O$-EtOH | 2% aqueous DMAB | 9.0 |
| 24 | 8, 1.0%, 1:1 $H_2O$-EtOH | 1% aqueous hydrazine | 12.0 |
| 25 | 9, 1.0%, 1:1 $H_2O$-EtOH | 2% aqueous DMAB | 12.0 |
| 26 | 10, 1%, $H_2O$ | 2% aqueous DMAB | 4.0 |
| 27 | 11, 0.4% MeOH | 2% aqueous DMAB | <9.0 |
| 28 | 12, 0.25% MeOH | 1% hydrazine | 3.0 |
| 29 | 13, 0.5%, EtOH | 0.5% aqueous DMAB | 2.0 |
| 30 | 14, 0.5%, MeOH | 2% aqueous DMAB | 3.0 |
| 31 | 15, 1.0%, $H_2O$ | 4.0% aqueous DMAB | 3.0 |
| 32 | 15, 1%, $H_2O$ | 130 g. paraformaldehyde- +120 g KOH/1 liter water | 12.0 |
| 33 | 15, 1%, $H_2O$ | 0,1% aqueous hydrazine | 200 |
| 34 | 16, 0.1%, 1:1 $H_2O$-EtOH | 2% aqueous DMAB | <9.0 |
| 35 | 17, 0.5%, 1:1 $H_2O$-EtOH | 2% aqueous DMAB | 10.0 |
| 36 | 18, 1.0%, 1:1 $H_2O$-EtOH | 2% aqueous DMAB | 12.0 |
| 37 | 19, 1.0%, 1:1 $H_2O$-EtOH | 2% aqueous DMAB | <9.0 |
| 38 | 19, 1.0%, 1:1 $H_2O$-EtOH | 1% aqueous hydrazine | 12.0 |
| 39 | 20, 0.5%, MeOH | 1% aqueous hydrazine | 12.8 |

[a]pH adjusted by the addition of NaOH.
[b]DMAB is dimethylamine borane similar experiments with vacuum evaporated copper and slver showed the following results.

| Ex. | Developer Tsalt/conc./solvent | Formulation Reducing Agent Solution | Critical Coverage $\times 10^9$g/cm$^2$ |
|---|---|---|---|
| 40 | 1, 5%, $H_2O$ | 100 mg. methylhydrazine bisborane in 100 ml $H_2O$ | 30(Cu) (25° C) 15(Cu) (55° C) |
| 41 | 3, 1%, $H_2O$ | 100 mg. methylhydrazine bisborane in 100 ml $H_2O$ | 30(Cu) |
| 42 | 1, 5%, $H_2O$ | 100 mg. methylhydrazine bisborane in 100 ml $H_2O$ | 70(Ag) |

EXAMPLE 43

A dye physical developer solution was formulated by mixing equal volumes of solutions (1) and (2):

1. 250 mg. tetrazolium salt No. 13 (Table I) in 500 ml ethanol
2. aqueous solution .5% in dimethylamine borane and 0.5% in $ZnCl_2 \cdot 6H_2O$ The critical developable coverage was found to be $2 \times 10^{-9}$ g/cm$^2$ of Pd (Development time of 3 minutes). When the metal salt ($ZnCl_2 \cdot 6H_2O$) was omitted from the developer solution, the formazan dye formed was readily dissolved in the 50% water, 50% ethanol developer solution. The chelated form of the formazan dye was insoluble in this solvent mixture.

EXAMPLE 44

Example 43 was repeated except that the developer solution was maintained at 50° C. A dense color image was obtained after 15 seconds of development.

EXAMPLES 45–47

A copper complex of the formula $[Cu(diethylenetriamine)_2](B(C_6H_5)_4)_2$ was prepared as described in copending application Ser. No. 409,828, filed Oct. 26, 1973 by H. J. Gysling. Film samples containing this complex were prepared by coating (6 mil wet thickness) on gel subbed poly(ethylene terephthalate) a solution of 0.7 g. complex dissolved in 40 ml of 10% cellulose acetate (type S) (1:1 acetone - methoxyethanol). The film samples were then exposed and processed as follows:

| Ex. | Exposure | Developer | Image |
|---|---|---|---|
| 45 | 60 sec. 360 watt Gates Lamp | As in Example 5 above | Dark red |
| 46 | 15 sec. Gates Lamp | Equal volumes of 5% T-Salt 1 in $H_2O$ and 3% DMAB in $H_2O$ | Dark red |
| 47 | As in Example 45 | Equal volumes of 1% | Dark blue |

-continued

| Ex. | Exposure | Developer | Image |
|---|---|---|---|
| | | T-salt 15 in $H_2O$ and 200 mg. methyl-hydrazine bisborane /100 ml $H_2O$ | |

EXAMPLE 48

A copper complex of the formula $[Cu[P(C_6H_5)_3]_2BH_4]$ was prepared as described in copending application Ser. No. 365,374, filed May 30, 1973 to Gysling et al entitled "Photographic Systems based on Copper (I) Complexes". Paper stock was imbibed with a solution of 2 g. of the complex dissolved in 30 ml of tetrahydrofuran and dried. After a 10 minute exposure (360 watt Gates lamp) the paper was developed to a dark red image by immersion in the solution described in Example 5.

EXAMPLE 49

Example 48 was repeated except the paper sample was exposed for 30 seconds under a 360 watt Gates lamp and half of the exposed sample was heated 30 seconds at 150° C. Immersion in the developer gave amplification to a red negative image only on the heated side of the exposed paper.

EXAMPLE 50

A palladium complex of the formula $K_2[Pd(C_2O_4)_2]\cdot 2H_2O$ was prepared as described in Canadian Pat. 899,141. A film samples of the complex was prepared by imbibing a 0.5% aqueous solution into geltatin-coated poly(ethylene-terephthalate) (375 mg. gelatin/ft$^2$). After a 20 second imagewise Gates lamp exposure, a film sample was developed to a dark red image in the exposed areas by immersion in the developer described in Example 6.

EXAMPLE 51

A copper complex of the formula $[Cu(1,2\text{-propanediamine})_2][B(C_6H_5)_4]_2$ was prepared as described in copending application Ser. No. 409,828, filed Oct. 26, 1973 by H. J. Gysling. A film sample containing this complex was prepared by coating (6 mil wet thickness) on poly(ethylene terephthalate) subbed with copoly(ethyl acrylte-co-acrylic acid) a solution of 0.5 g. of the complex dissolved in 25 ml. of a 10% acetone solution of poly N-[2-(2-methyl-4-oxopentyl)]acrylamide.

A film strip was exposed imagewise for 60 seconds under a 360 watt Gates lamp and developed in the exposed areas to a red image by immersion in a developer consisting of 5 g. compound 1 (from Table I) in 100 ml. water mixed with a solution of 6g DMAB in 50 ml. water.

EXAMPLE 52

A copper complex of the formula $Cu[As(p\text{—}CH_3\text{—}C_6H_4)_3]_3\ BH_3CN$ was was prepared as described in copending application Ser. No. 365,375, filed May 30, 1973 to Gysling entitled "Photosensitive Copper (I) Complexes". A film sample containing this complex was prepared by dissolving 250 mg. of the complex in 10 ml. of a 10% solution of poly(ethyl acrylate-co-acrylic acid) in acetonitrile (2drop of hardener PFAZ (as 10% dioxane solution) was added before coating). (PFAZ is a polyfunctional aziridine made by the Ionac Chemical Company.) This solution was then coated (6 mil wet thickness on poly(ethyl acrylate-co-acrylic acid) subbed poly(ethylene terepthalate) and allowed to harden for 48 hours at 40° C.

A film sample was exposed imagewise for 60 seconds under a 360 watt Gates lamp and developed to a red negative image by immersion in the developer described in Example 51.

EXAMPLE 53

Sensitized stock was prepared by imbibing a solution of 200 mg of $[PdLN_3]B(C_6H_5)_4$ (L = N,N,N',N'-tetraethyldiethylenetriamine) in 10 ml acetone into paper stock. The sensitized paper was given a 15 second imagewise exposure with a UVS-12 Mineralight hand lamp (Ultra Violet Products, San Gabriel, California) and then developed to a red negative image by immersion for 60 seconds in a developer consisting of an aqueous solution that was 2.5% (by weight) 2,3,5-triphenyl-2H-tetrazolium chloride and 1.5% (by weight) DMAB.

EXAMPLE 54

Sensitized paper stock prepared as in Example 53 was exposed to an electron beam ($i = 10^{-7}$ amp; V = 10 kv) and developed in a dye physical developer that consisted of an aqueous solution that was 2.5% in 2,3,5-triphenyl-2H-tetrazolium chloride and 4% DMAB. Red negative images were obtained with exposures down to ca. $10^{13}$ electrons/cm$^2$.

EXAMPLE 55

Sensitized stock was prepared by imbibing a solution of 2.5 g. 2,3,5-triphenyl-2H-tetrazolium chloride in 100 ml water into film stock prepared by imbibing a 0.5% aqueous solution of $K_2Pd(C_2O_4)_2.2H_2O$ into gelatin-coated Estar (375 mg. gelatin/ft$^2$). After a 10-minute imagewise UVS-54 lamp exposure, the film was developed to a red image in the unexposed areas by immersion in a 2.0% aqueous solution of hydrazine.

The process as disclosed herein yields a highly light stable, high resolution formazan dye image. The process is extremely flexible in that a wide variety of tetrazolium salts, reducing agents and methods of forming nuclei such as by the use of various light sensitive compositions may be used. The developer solutions as described herein are simple, stable, and inexpensive to formulate. As such the process of this invention may be used in a wide variety of applications such as microfilm and copying.

The invention has been described in detail with particular reference to preferred embodiments thereof, but it will be understood that variations and modifications can be effected within the spirit and scope of the invention.

We claim:

1. A process of preparing a formazan dye image comprising forming an image comprising nuclei of one or more metals from Groups VIIIB and/or IB of the periodic table and catalytically reducing a terazolium salt in contact with said nuclei, a reducing agent that does not spontaneously reduce said tetrazolium salt.

2. A process of preparing a formazan dye image comprising imagewise exposing to electromagnetic radiation a photographic element comprising a photographic layer comprising one or more light sensitive complexes of metals from Groups VIIIB and/or IB of the periodic table to form a latent image of catalytic metal nuclei in said layer and catalytically reducing a tetrazolium salt in contact with said nuclei, a reducing agent that does not spontaneously reduce said tetrazolium salt or said light sensitive complexes.

3. The process of claim 2 wherein the tetrazolium salt and the reducing agent are added together in the form of a physical developer solution for said photographic element element containing said imagewise exposed light sensitive complexes.

4. The process of claim 2 wherein the light sensitive complex is $K_2[Pd(C_2O_4)_2].2H_2O$, the tetrazolium salt is 2,3,5-triphenyl-2H-tetrazolium chloride and the reducing agent is hydrazine.

5. The process of claim 2 wherein the light sensitive complex has the formula $$[PdLX]B(C_6H_5)_4$$

where L is the ligand N,N,N',N'-tetraethyldiethylenetriamine and X is halide, $N_3^-$, $SCN^-$, $SeCN^-$ or $BH_3CN^-$.

6. The process of claim 5 wherein the light sensitive complex is [Pd(1,1,7,7-tetraethyldiethylenetriamine) $N_3]B(C_6H_5)_4$, the tetrazolium salt is 2,3,5-triphenyl-2H-tetrazolium chloride and the reducing agent is dimethylamine borane.

7. The process of claim 2 wherein the light sensitive complex is exposed to radiation in the UV to visible portion of the electromagnetic spectrum to produce the catalytic nuclei.

8. The process of claim 2 wherein the light sensitive complex is exposed to electron beam energy to produce the catalytic nuclei.

9. A photographic element comprising a photosensitive layer comprising one or more light sensitive complexes of metals from group VIIIB and/or IB of the periodic table said complexes being capable of forming catalytic metal nuclei on exposure to electromagnetic radiation, a layer comprising a tetrazolium salt and the layer comprising a reducing agent which does not spontaneously reduce said tetrazolium salt or said light sensitive complexes and being cable of reducing said tetrazolium salt to formazan dye in the presence of said catalytic metal nuclei, said layers being in reactive association.

10. The photographic element of claim 9 where the light sensitive complex is $K_2Pd(C_2O_4)_2.2H_2O$.

11. The photographic element of claim 9 where the tetrazolium salt is 2,3,5-triphenyl-2H tetrazolium chloride.

12. The photographic element of claim 9 where the reducing agent is hydrazine.

13. The photographic element of claim 9 where the light sensitive complex is $K_2Pd(C_2O_4)_2.2H_2O$ and the tetrazolium salt is 2,3,5-triphenyl-2H-tetrazolium chloride and the reducing agent is hydrazine.

14. A photographic element comprising a photosensitive layer comprising one or more light sensitive complexes of metals from Group VIIIB and/or IB of the periodic table said complexes being capable of forming catalytic metal nuclei on exposure, to electromagnetic radiation and a layer comprising a tetrazolium salt said layers being in reactive association.

15. The photographic element of claim 14 wherein the light sensitive complex is $K_2Pd(C_2O_4)_2.2H_2O$.

16. The photographic element of claim 14 wherein the tetrazolium salt is 2,3,5-triphenyl 2H-tetrazolium chloride.

17. The photographic element of claim 14 wherein the light sensitive complex is $K_2Pd(C_2O_4)_2.2H_2O$ and the tetrazolium salt is 2,3,5-triphenyl-2H-tetrazolium chloride.

* * * * *